US008011128B1

(12) United States Patent
Johnston

(10) Patent No.: US 8,011,128 B1
(45) Date of Patent: Sep. 6, 2011

(54) APPARATUS AND METHOD OF USE FOR UNIFORM MUZZLE LOADING

(75) Inventor: Kenneth Johnston, Okemos, MI (US)

(73) Assignee: Barbara Ann Johnston, Okemos, MI (US)

( * ) Notice: Subject to any disclaimer, the term of this patent is extended or adjusted under 35 U.S.C. 154(b) by 402 days.

(21) Appl. No.: 12/378,749

(22) Filed: Feb. 19, 2009

(51) Int. Cl.
*F41C 7/00* (2006.01)

(52) U.S. Cl. ..... 42/51; 89/1.3; 86/29; 86/30

(58) Field of Classification Search ..... 42/51, 95, 42/90, 106; 89/1.3, 47; 73/41.89, 78, 862.381, 73/81, 700, 862.53, 862.621, 862.636, 862.641, 73/770, 790, 818, 862.01, 161, 862.05, 862.471, 73/862.392, 85, 84, 1.08; 86/29, 30; 124/37, 124/38

See application file for complete search history.

(56) References Cited

U.S. PATENT DOCUMENTS 481,887 A * 8/1892 Beardsley ..... 86/30
659,724 A * 10/1900 Wills ..... 86/23
673,693 A * 5/1901 Beaufils ..... 473/45
1,670,685 A * 5/1928 Marks ..... 73/81
2,321,770 A * 6/1943 Persson ..... 86/30
2,421,449 A * 6/1947 Zuber ..... 73/81
2,777,436 A * 1/1957 Renner ..... 124/27
3,224,141 A * 12/1965 Borak ..... 446/137
3,246,895 A * 4/1966 Traill ..... 473/45
3,447,805 A * 6/1969 Baley et al. ..... 473/45
3,495,826 A * 2/1970 Mizgala ..... 473/45
3,693,418 A * 9/1972 Kaspareck et al. ..... 73/85
3,897,061 A * 7/1975 Grattan ..... 473/511
4,134,588 A * 1/1979 Di Luzio ..... 473/45
4,159,640 A * 7/1979 Leveque et al. ..... 73/81
4,377,125 A * 3/1983 Westfall ..... 116/67 R
4,466,210 A * 8/1984 Koontz ..... 42/90
4,505,278 A * 3/1985 Alban ..... 600/587
4,526,370 A * 7/1985 Mortellacci ..... 473/45
4,813,169 A * 3/1989 Calliebe ..... 42/90
4,852,451 A * 8/1989 Rogers ..... 86/33
5,016,380 A * 5/1991 Jones ..... 42/90
5,301,912 A * 4/1994 Chang ..... 248/221.11
5,417,004 A * 5/1995 Krantz ..... 42/90
5,706,598 A 1/1998 Johnston
6,385,887 B1 5/2002 Johnston

* cited by examiner

*Primary Examiner* — Michael Carone
*Assistant Examiner* — Jonathan C Weber
(74) *Attorney, Agent, or Firm* — Ian C. McLeod

(57) ABSTRACT

The present invention relates to an apparatus for loading a barrel of a muzzle loading firearm to provide powder and a projectile at a breach end of the barrel. The apparatus comprises: (i) a handle having a central longitudinal axis and adapted to be gripped by one hand, the handle having an opening between opposed ends along the axis; (ii) a moveable casing having a head and mounted in the opening adjacent one end of the handle and adapted to receive a ramrod of the muzzle loading rifle into the casing; (iii) a retaining means for retaining the casing within the opening, the retaining means mounted on the handle with at least a portion of the retaining means mounted inside the opening; and (iv) a coil spring mounted in the opening inside the handle between the portion of the retaining means mounted in the opening and the head of the casing. When the ramrod is used to force the projectile onto powder in the barrel at the breach end, the casing is moved towards the portion of the starter against the coil spring to pressure the projectile against the powder. The retaining means can comprise a starter for the projectile extending from one end of the handle. The starter is adapted to start a projectile in the barrel of the muzzle loading firearm.

19 Claims, 5 Drawing Sheets

APPARATUS AND METHOD OF USE FOR UNIFORM MUZZLE LOADING

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A "COMPUTER LISTING APPENDIX SUBMITTED ON A COMPACT DISC"

Not Applicable.

BACKGROUND OF THE INVENTION (1) Field of the Invention

The present invention relates generally to an apparatus for muzzle loading, particularly an apparatus for efficient and uniform loading of a projectile into a muzzle.

(2) Description of the Related Art

An important aspect when using a traditional muzzle loading or black powder firearm is to facilitate quick, reliable and consistent reloading of the firearm. As is conventionally known in the art, a desired volume of gun propellent is supplied to either the muzzle end or the breech end of the barrel of a gun, depending on the design of the firearm. During loading of a muzzle loading firearm, the charge, the sabot or patch (wad), if necessary, and the projectile (i.e., ball or bullet), are all loaded through the discharging end of the barrel. Sometimes the sabot or patch (wad) will be omitted. The contents are typically packed toward the breech end of the firearm using a ramrod to ensure a consistent loading and seating pressure of the propellant and the projectile and the seating reduces the chances of an inadvertent blow up of the barrel of the firearm because of an air gap formed between the propellant and the projectile.

As is well known in the art, the propellent is typically loose granular gunpowder, e.g., a mixture of charcoal, potassium nitrate and sulfur. Early powders were dangerous to handle and tended to foul the bore of the firearm. For a number of years, black powder was the only propellent used in muzzle loading firearms, and eventually black powder substitutes, such as those sold under the trade names PYRODEX, BLACK CANYON, CLEAN SHOT and AMERICAN PIONEER, are now commonly utilized. For many years, black powder and black powder substitutes have been pelletized to facilitate ease of loading of firearms.

Manually packing firearm contents (i.e., the projectile and powder) near the breech end of the firearm with a ramrod can lead to inconsistent loading. This creates a significant disadvantage when precision firing is required. The ramrod is generally maneuvered manually, without the help of a precision tool or consistent force application. This leads to significant differences between reloads and most certainly among different users having different strength tolerances. Accordingly, there remains a need for a tool or apparatus for facilitating uniform loading.

U.S. Pat. No. 6,385,887 issued to Johnston, describes an adaptor which allows a standard casing firing action to be used with a muzzle loading firearm. The adaptor includes a breech plug and a nipple and is configured to be inserted into the barrel of the firearm adjacent the receiver. The breech end of the nipple has a conical shape. In use, a standard ignition casing having a head, with a primer mounted in the flash hole in the head, is loaded into the receiver of the firearm. Next, the ignition casing is moved into the breech end of the barrel such that the casing extends into the center bore of the breech plug and the breech end of the nipple extends into the end of the flash hole in the head of the casing and is adjacent the primer. When the firearm is fired, the firing pin contacts the primer which ignites the primer. The spark from the primer travels directly through the center bore of the nipple through the center openings of the propellant pellets which ignites the propellant pellets which expels the projectile from the firearm. U.S. Pat. No. 6,385,887 is hereby incorporated by reference in its entirety for all purposes.

U.S. Pat. No. 5,706,598 issued to Johnston, describes a muzzle loading firearm having an insert (breech plug) and adaptor for use with a casing having a primer. The insert is threadably mounted in the center bore of the barrel adjacent the receiver. The nipple is threadably mounted in the center bore of the insert. However in my previous invention, the end of the nipple over which the casing is mounted is flat. Thus, the end of the nipple does not extend into the flash hole in the casing. Further, the flash hole of the casing opposite the primer is not sized to accommodate the end of the nipple. Thus, the casing is not held in sealing contact with the nipple when the firearm is fired. U.S. Pat. No. 5,706,598 is hereby incorporated by reference in its entirety for all purposes.

There remains the need for an apparatus which enables consistent and uniform loading of a muzzle loading firearm when packing contents with a ramrod.

OBJECTS

Therefore, it is an object of the present invention to provide an apparatus for facilitating consistent and uniform loading of firearm contents, such as a projectile and powder, into a muzzle of a firearm using a ramrod. Particularly, the apparatus provides an audible indicator to the user when the appropriate and/or desired loaded pressure has been achieved.

SUMMARY OF THE INVENTION

The present disclosure provides for an apparatus for loading a barrel of a muzzle loading firearm to provide powder and a projectile at a breech end of the barrel. In an exemplary embodiment, the apparatus comprises: (a) a handle having a central longitudinal axis and adapted to be gripped by one hand, the handle having an opening between opposed ends along the axis; (b) a moveable casing having a head and mounted in the opening adjacent one end of the handle and adapted to receive a ramrod of the muzzle loading rifle into the casing; (c) a retaining means for retaining the casing within the opening, the retaining means mounted on the handle with at least a portion of the retaining means mounted inside the opening; and (d) a coil spring mounted in the opening inside the handle between the portion of the retaining means mounted in the opening and the head of the casing. When the ramrod is used to force the projectile onto powder in the barrel at the breech end, the casing is moved towards the portion of the starter against the coil spring to pressure the projectile against the powder. The retaining means can comprise a starter for the projectile extending from one end of the handle. The starter is adapted to start a projectile in the barrel of the muzzle loading firearm. In an exemplary embodiment, the head of the casing contacts a detent mounted through the handle into the opening when the casing is pushed back against the spring by the ramrod to provide an audible sound indicating that a predetermined pressure of the projectile on the powder in the barrel has been achieved. The head of the casing can be a rimless casing with an extraction groove which engages the detent to provide the audible sound.

The present disclosure provides for an apparatus for loading a barrel of a muzzle loading firearm to provide powder and a projectile at a breech end of the barrel. In an exemplary embodiment, the apparatus comprises: (a) a handle having a central longitudinal axis and adapted to be gripped by one hand, the handle having opposed, flanged ends, wherein the handle has a cylindrical opening between the flanged ends along the axis; (b) a moveable casing having a head and mounted in the cylindrical opening adjacent one flanged end of the handle and adapted to receive a ramrod of the muzzle loading rifle into the casing; (c) a retaining means for retaining the casing within the cylindrical opening, the retaining means mounted on the handle with at least a portion of the retaining means mounted inside the cylindrical opening; and (d) a coil spring mounted in the cylindrical opening inside the handle between the portion of the retaining means mounted in the cylindrical opening and the head of the casing. When the ramrod is used to force the projectile onto powder in the barrel at the breech end, the casing is moved towards the portion of the retaining means against the coil spring to pressure the projectile against the powder.

In an exemplary embodiment, the retaining means comprises a starter for the projectile extending from one end of the handle. The starter is adapted to start a projectile in the barrel of the muzzle loading firearm. The starter defines a pocket that is sized and shaped to receive a portion of the projectile to be seated in the barrel of the muzzle loading firearm. The cylindrical opening defines a keyed recess parallel to the axis partially extending along an internal surface of the opening and sized and shaped to receive a keyed boss extending along the starter for alignment and mounting of the starter in the handle. The keyed recess defines a stop to abut against the keyed boss of the starter to prevent further insertion of the starter into the cylindrical opening. The starter is securely held within the cylindrical opening by a securing means. In an exemplary embodiment, the head of the casing contacts a detent mounted through the handle into the cylindrical opening when the casing is pushed back against the spring by the ramrod to provide an audible sound indicating that a predetermined pressure of the projectile on the powder in the barrel has been achieved. The head of the casing is a rimless cartridge casing with an extraction groove which engages the detent to provide the audible sound. In an exemplary embodiment, the detent comprises a spring loaded ball bearing mounted in a threaded member and mounted in a threaded opening extending perpendicular to the longitudinal axis of the handle. The coil spring defines a predetermined tension adapted to receive pressure from the ramrod pressing against the casing until a desired pound of pressure is achieved in loading the projectile in the barrel of the muzzle loading firearm.

The present disclosure provides for an apparatus for loading a barrel of a muzzle loading firearm to provide powder and a projectile at a breech end of the barrel. In an exemplary embodiment, the apparatus comprises: (a) a handle having a central longitudinal axis and adapted to be gripped by one hand, the handle having opposed, flanged ends, wherein the handle has a cylindrical opening between the flanged ends along the axis; (b) a moveable casing having a head and mounted in the cylindrical opening adjacent one flanged end of the handle and adapted to receive a ramrod of the muzzle loading rifle into the casing; (c) a starter for the projectile mounted on the handle with an end extending from the other flanged end of the handle with a portion of the starter mounted inside the cylindrical opening, the starter is adapted to start a projectile in the barrel of the muzzle loading firearm; and (d) a coil spring mounted in the cylindrical opening inside the handle between the portion of the starter mounted in the cylindrical opening and the head of the casing. When the ramrod is used to force the projectile onto powder in the barrel at the breech end, the casing is moved towards the portion of the starter against the coil spring to pressure the projectile against the powder. In a further embodiment, the head of the casing contacts a detent mounted through the handle into the cylindrical opening when the casing is pushed back against the spring by the ramrod to provide an audible sound indicating that a predetermined pressure of the projectile on the powder in the barrel has been achieved. The head of the casing is a rimless cartridge casing with an extraction groove which engages the detent to provide the audible sound. In yet a further embodiment, the detent comprises a spring loaded ball bearing mounted in a threaded member and mounted in a threaded opening extending perpendicular to the longitudinal axis of the handle.

The present disclosure provides for a method for loading a barrel of a muzzle loading firearm to provide powder and a projectile at a breech end of the barrel, which comprises the steps of: (a) providing an apparatus for loading a barrel of a muzzle loading firearm comprised of: (i) a handle having a central longitudinal axis and adapted to be gripped by one hand, the handle having an opening between opposed ends along the axis; (ii) a moveable casing having a head and mounted in the opening adjacent one end of the handle and adapted to receive a ramrod of the muzzle loading rifle into the casing; (iii) a retaining means for retaining the casing within the opening, the retaining means mounted on the handle with at least a portion of the retaining means mounted inside the opening, and (iv) a coil spring mounted in the opening inside the handle between the portion of the retaining means mounted in the opening and the head of the casing, wherein when the ramrod is used to force the projectile onto powder in the barrel at the breech end, the casing is moved towards the portion of the starter against the coil spring to pressure the projectile against the powder; (b) seating a projectile in the barrel of a muzzle loading firearm; and (c) inserting the projectile into the barrel with one end of a ramrod by placing the opposite end of the ramrod into the cylindrical opening against the casing.

The present disclosure provides for a method for loading a barrel of a muzzle loading firearm to provide powder and a projectile at a breech end of the barrel, which comprises the steps of: (a) providing an apparatus for loading a barrel of a muzzle loading firearm comprised of: (i) a handle having a central longitudinal axis and adapted to be gripped by one hand, the handle having opposed, flanged ends, wherein the handle has a cylindrical opening between the flanged ends along the axis; (ii) a moveable casing having a head and mounted in the cylindrical opening adjacent one flanged end of the handle and adapted to receive a ramrod of the muzzle loading rifle into the casing; (iii) a retaining means for retaining the casing within the cylindrical opening, the retaining means mounted on the handle with at least a portion of the retaining means mounted inside the cylindrical opening, and (iv) a coil spring mounted in the cylindrical opening inside the handle between the portion of the retaining means mounted in the cylindrical opening and the head of the casing, wherein when the ramrod is used to force the projectile onto powder in the barrel at the breech end, the casing is moved towards the portion of the retaining means against the coil spring to pressure the projectile against the powder; (b) seating a projectile in the barrel of a muzzle loading firearm; and (c) inserting the projectile into the barrel with one end of a ramrod by placing the opposite end of the ramrod into the cylindrical opening against the casing. In a particular embodiment, the retaining means comprises a starter for the projectile extending from then end of the handle. The starter is adapted to start a projectile in the barrel of the muzzle loading firearm. The starter defines a pocket that is sized and shaped to receive a portion of the projectile to be seated in the barrel of the muzzle loading firearm. The starter can be securely held within the cylindrical opening by a securing means. The cylindrical opening defines a keyed recess parallel to the axis partially extending along an internal surface of the handle and sized and shaped to receive a keyed boss extending along the starter for alignment and mounting of the starter in the handle, and wherein the keyed recess defines a stop to abut against the keyed boss of the starter to prevent further insertion of the starter into the cylindrical opening.

In an exemplary embodiment, the head of the casing contacts a detent mounted through the handle into the cylindrical opening when the casing is pushed back against the spring by the ramrod to provide an audible sound indicating that a predetermined pressure of the projectile on the powder in the barrel has been achieved. The head of the casing is a rimless casing with an extraction groove which engages the detent to provide the audible sound. The detent comprises a spring loaded ball bearing mounted in a threaded member and mounted in a threaded opening perpendicular to the longitudinal axis of the handle. The coil spring defines a predetermined tension adapted to receive pressure from the ramrod pressing against the casing until a desired pound of pressure is achieved in loading the projectile in the barrel of the muzzle loading firearm.

DESCRIPTION OF THE PREFERRED EMBODIMENTS

Figure 1:
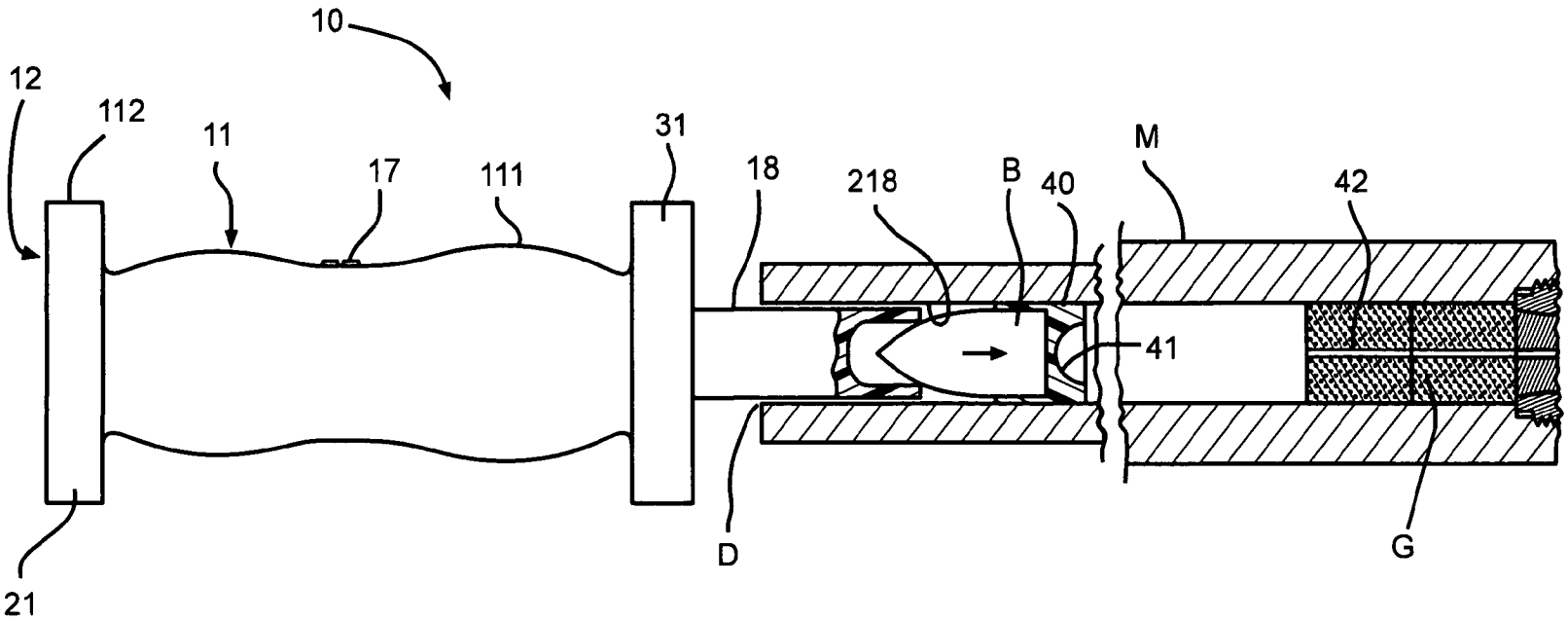
FIG. 1 illustrates an apparatus of the present disclosure comprising a bullet starter seating a bullet into the discharging end of a barrel of a muzzle loading firearm.

All patents, patent applications, government publications, government regulations, and literature references cited in this specification are hereby incorporated herein by reference in their entirety. In case of conflict, the present description, including definitions, will control.

The term "detent" as used herein refers to a device or part which fits into a notch or pocket locking or unlocking a movement; also including a ball bearing with spring mechanism that engages a groove and induces an audible indication when engaged into the groove.

The term "powder" as used herein refers to gun powder, black powder or any equivalent whether provided in loose form or by way of pellets which are well known in the art.

The term "casing" as used herein refers to a case or covering; housing, particularly a casing for a cartridge having a head and an opening sized to receive a ramrod, typically defining a substantially cylindrical geometry.

The term "projectile" as used herein refers to an object fired from a gun with an explosive propelling charge, such as a bullet, shell, ball, or bullet with sabot.

The term "sabot" as used herein refers to a soft plastic or metal ring at the base and sides of a projectile that makes the projectile conform to the rifling grooves of a gun.

The term "muzzle" as used herein refers to a barrel and an opening of a barrel of a firearm, particularly with reference to a barrel of a muzzle loading firearm.

The present disclosure provides for an apparatus for loading a barrel of a muzzle loading firearm to provide powder and a projectile at a breech end of the barrel. With reference to FIGS. 1-5, an exemplary apparatus 10 is shown. Apparatus 10 comprises an elongated handle 11 having an outer surface 111 and internal surface 211. Handle 11 defines a longitudinal axis extending from a first end 112 to a second end 212. In an exemplary embodiment, handle 11 defines an opening 12 extending from the first end 112 to the second end 212 along the longitudinal axis. Preferably, opening 12 is a cylindrical opening as shown in the Figures. Positioned within cylindrical opening 12 is a coil spring 13. Abutting against coil spring 13 is an internal casing 14. Internal casing 14 is also positioned within cylindrical opening 12. In an exemplary embodiment, casing 14 defines a casing opening 114 adapted to receive a ramrod R through opening 12. Casing 14 further defines a head 214 abutting coil spring 13. In a particular embodiment, head 214 defines an extraction groove 215. Groove 215 is defined along an external surface 115 of casing 14 and is adapted to slide along internal surface 211 of handle 11. Head 214 can further define a hole 216 to prevent damage to ramrod R during insertion. Casing 14 is adapted to translate inwardly a distance T compressing the spring a compression C (See FIG. 5) in the presence of a force applied from ramrod R when loading the barrel of the muzzle loading firearm.

Figure 3:
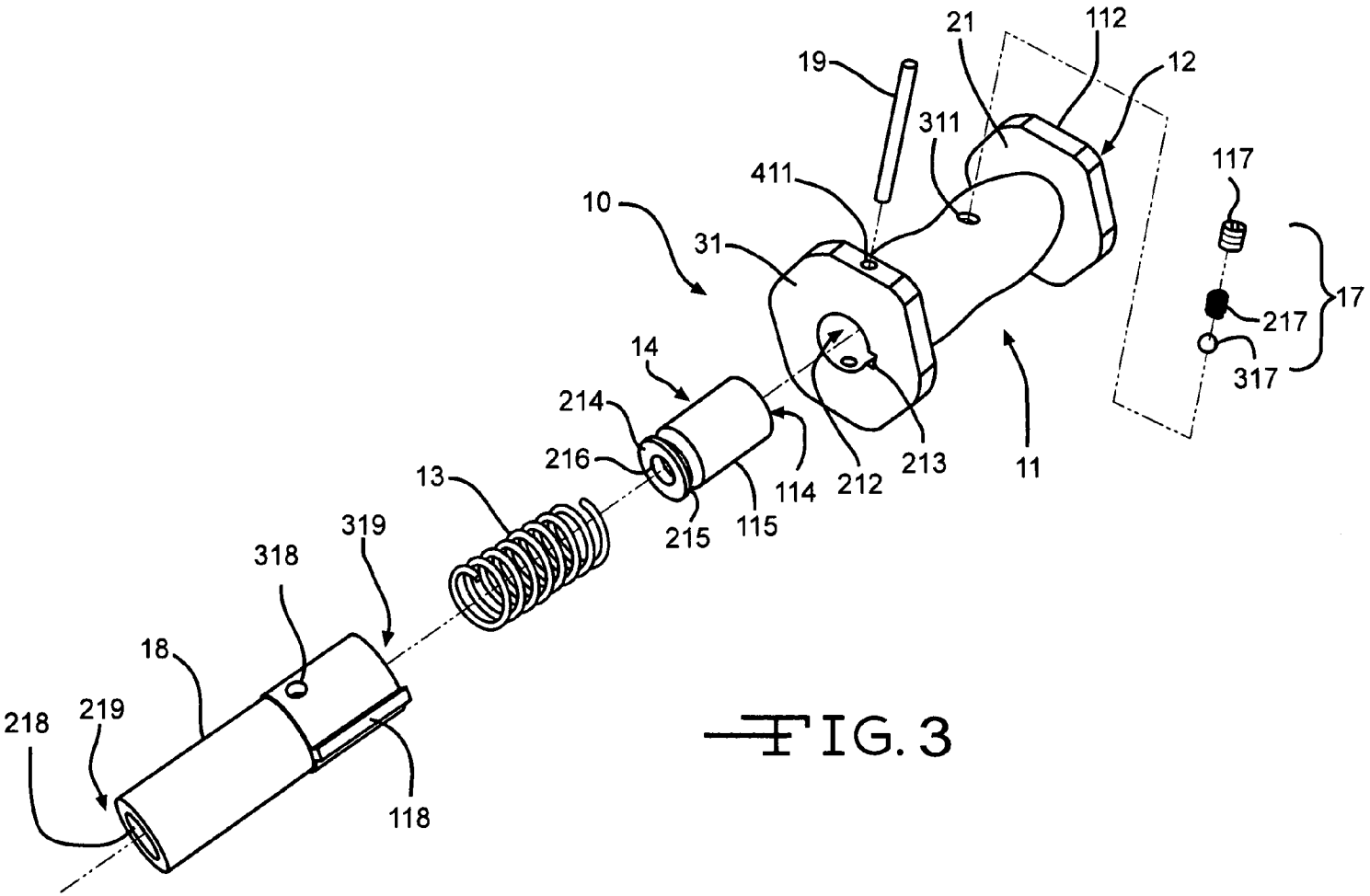
FIG. 3 illustrates an exploded view of the apparatus of FIG. 1.
Figure 4:
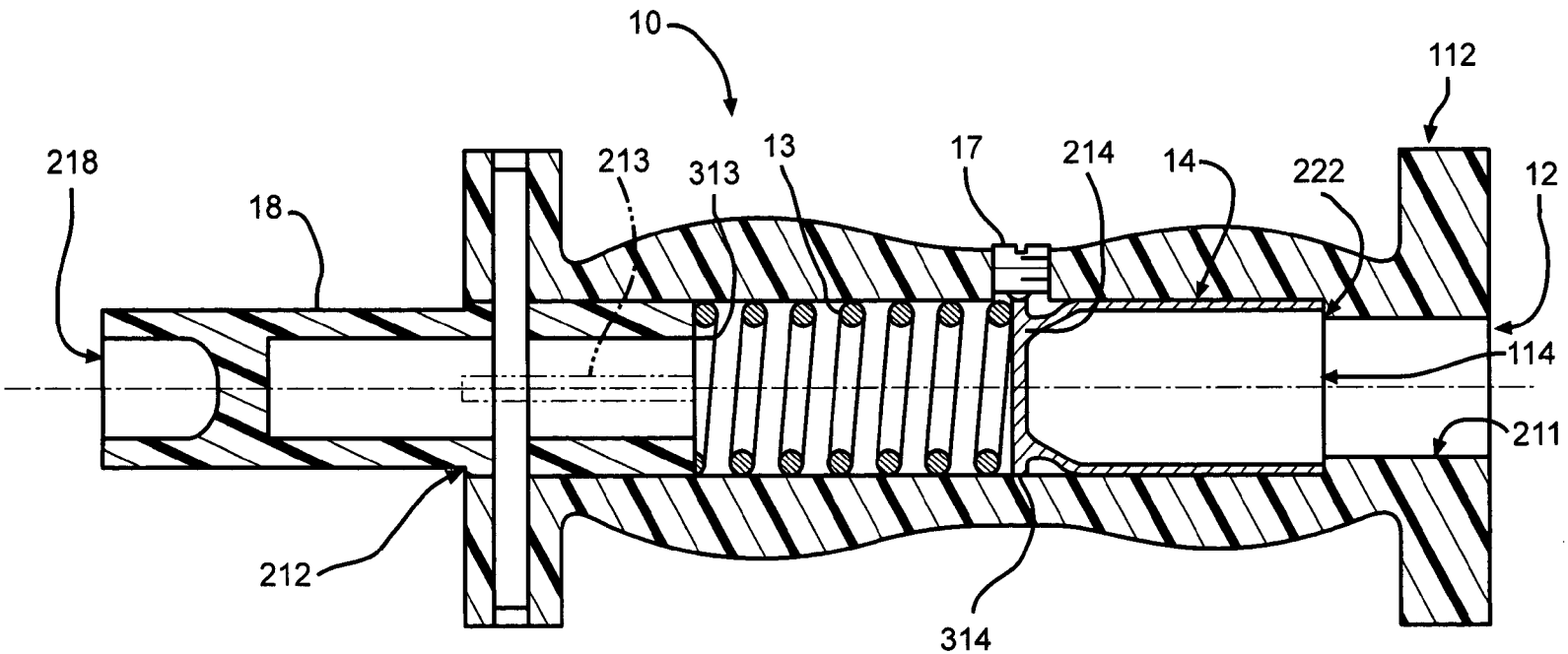
FIG. 4 illustrates a cross section view of the apparatus of FIG. 1 with the detent not engaged in the groove.

FIG. 3 illustrates an exploded view of an exemplary apparatus 10. Typically, apparatus 10 is constructed by inserting coil spring 13 and casing 14 into the cylindrical opening of handle 11 through opening 12 at second end 212 of handle 11. Casing 14 abuts against an internal stop 222 as shown in FIG. 4. Coil spring 13 is inserted through the opening of second end 212 and thus abuts against closed end 214 of casing 14. Casing opening 114 is exposed in the same direction of cylindrical opening 12 to receive ramrod R through the openings. Stop 222 ensures desired positioning of casing 14 and coil spring 13 within handle 11. Coil spring 13 is retained within cylindrical opening 12 by a retaining means 18. At least a portion of retaining means 18 is mounted within cylindrical opening 12.

In an exemplary embodiment, apparatus 10 comprises a detent 17 mounted within cylindrical opening 12 extending through handle 11 perpendicular to the longitudinal axis of the handle. Detent 17 is comprised of a spring mounting feature 117, a ball bearing spring 217 and a ball 317 constructed together to be inserted through handle 11. Mounting feature 117 can be a threaded member (i.e., a screw). Typically an end of the mounting feature 117 lies flush with the outer surface 11 when fully inserted. Outer surface 111 can further define a ball bearing hole 311 (i.e., a threaded opening) for allowing the mounting of detent 17. Detent 17 is constructed and mounted within handle 11 such that a click or an audible indication is induced when casing 14 is translated past a point when detent 17 engages extraction groove 215. Accordingly, at rest (i.e., no ramrod is being inserted against casing 14), ball 317 of detent 17 is compressed against a circumferential portion 314 of head 214. In this state, spring 217 is at least partially compressed. During use, when ramrod R translates casing 14 inward, thereby compressing coil spring 13, ball 317 slides into groove 215. When ball 317 slides into groove 215 as shown with respect to FIG. 5, spring 217 is either less compressed or no longer compressed. Furthermore, the action of ball 317 sliding into groove 215 induces an audible sound (such as a clicking noise) as an indication that a projectile B has reached a desired pressure when compacted against gun powder G. Mounting feature 117 can be a member selected from the group consisting of a screw, a bolt, a pin and a rod. As shown in FIG. 3, mounting feature 117 is a threaded screw.

Figure 2:
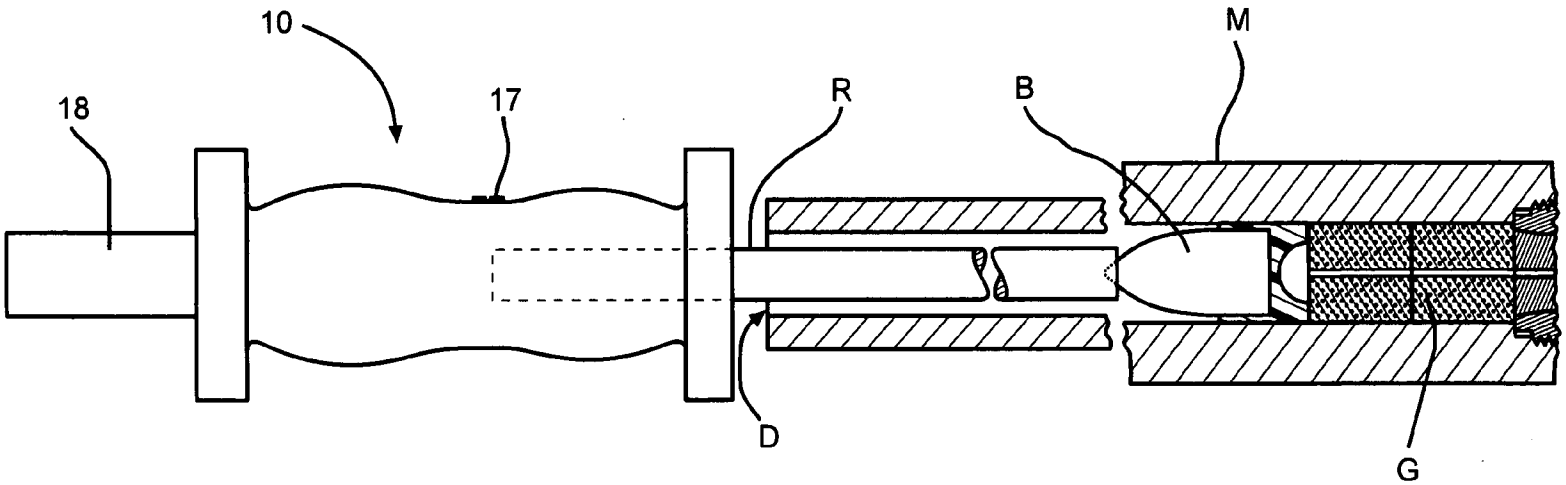
FIG. 2 illustrates the apparatus of FIG. 1 in use with a ramrod for inserting the bullet down the barrel of the firearm.

In an exemplary embodiment, gun powder G is supplied as pellets rather than loose powder. In a further embodiment, the pellets define a small opening 42 to allow for ignition (i.e., a spark from a trigger) to ignite all of the powder almost simultaneously causing a more consistent and powerful firing. Projectile B can be provided as a bullet, a bullet with sabot or a ball (not shown). Preferably, bullet B is encased in a sabot 40 defining a dimple 41 to allow for the ignition through opening 42 to properly drive bullet B through muzzle M to the discharge end D. Bullet B is inserted through muzzle M down the barrel by way of a ramrod R. One end of ramrod R (as shown in FIG. 2) pushes bullet B down the barrel towards a breech end of the firearm. Bullet B is then pressed against gun powder pellets G to a desired loading pressure. Using apparatus 10 to push against the opposite end of ramrod R facilitates achieving a desired loading pressure. Moreover, using apparatus 10 can provide for improved uniformity and consistency in loading.

Apparatus 10 comprises a retention means 18. In an exemplary embodiment, retention means 18 is partially mounted within the cylindrical opening 12 as at second end 212. In a further embodiment, retention means 18 further comprises a starter for the projectile extending from second end 212 along the longitudinal axis of handle 11. Starter 18 defines a bullet pocket 218 at an exposed end 219 and a keyed boss 118 partially defined along an outer surface of starter 18 up to mounting end 319. As shown in FIG. 1, bullet pocket 218 is sized and shaped to receive a portion of projectile B to be seated in muzzle M at the discharge end D. Keyed boss 118 cooperates with a keyed recess 213 along internal surface 211 at second end 212. Recess 213 partially extends along the longitudinal axis of handle 11 up to a stop 313. Stop 313 is positioned to ensure desired mounting of starter 18 within handle 11. Moreover, the keyed alignment of recess 213 and boss 118 ensures proper alignment of mounting hole 318 with respect to a corresponding mounting hole 411 of handle 11. A securing means 19 is inserted through hole 411 and hole 318 to securely mount starter 18 within opening 12 at second end 212. Accordingly, starter 18 can be used to seat projectile B into the discharging end D of muzzle M. First end 112 can then be used to apply force to ramrod R to insert projectile B down the barrel of muzzle M to a desired loading pressure against pellets G. Securing means 19, as shown in FIG. 3, is a pin. In an exemplary embodiment, securing means 19 can be selected from the group consisting of a pin, a screw, a bolt, and a rod.

In an exemplary embodiment, outer surface 111 of handle 11 is fashioned to provide for a grippable surface having opposed flanged ends 21 and 31. Typically flanged ends 21 and 31 are opposite each other at opposed ends 112 and 212. Hole 411 for receiving securing means 19 is defined in flanged end 31. Flanged ends 21 and 31 can define a substantial hexagonal geometry. A hexagonal geometry substantially deters apparatus 10 from undesired rolling when a user sets apparatus 10 down on a surface. Typically, grippable surface 111 is disposed between flanged ends 21 and 31. Grippable surface 111 and flanged ends 21 and 31 are constructed to facilitate convenient and comfortable gripping to a user. In an exemplary embodiment, surface 111 and flanged ends 21 and 31 are constructed to be slightly smaller than a typical person's hand to provide for a safety mechanism in case the firearm unintentionally fires. If apparatus 10 is constructed to be slightly smaller than an average hand, then it will easily dislodge and pop out of the users hand in the event of a misfire.

Figure 5:
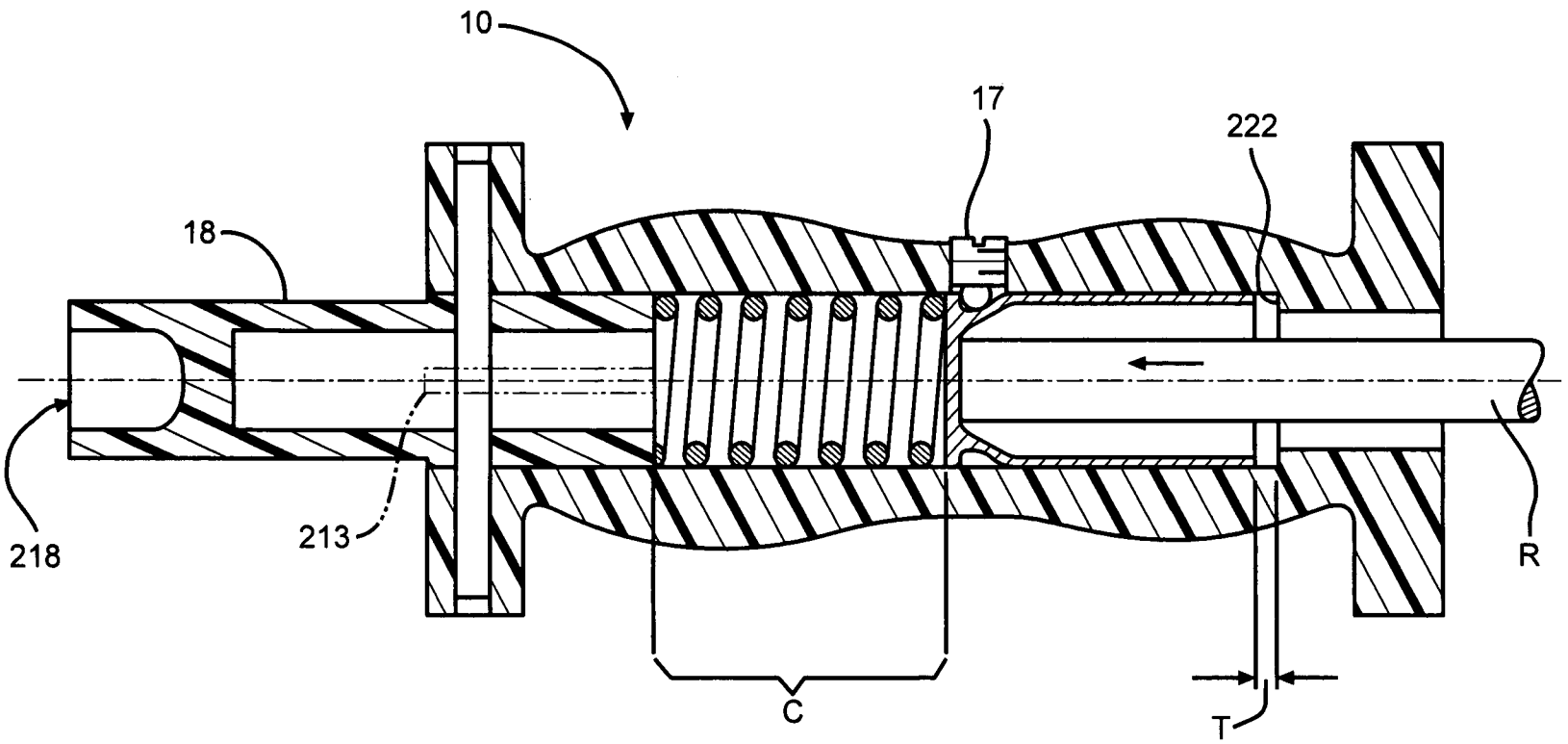
FIG. 5 illustrates the cross section view from FIG. 4 in a compressed state with the insertion of ramrod R with the detent engaged in the groove.

Coil spring 13 can define a predetermined tension or compression C (as shown in FIG. 5) adapted to receive pressure from ramrod R pressing against casing 14 until a desired pound of pressure (preferably 10 to 400 pounds per square inch) is achieved in loading projectile B in muzzle M. When force is applied to casing 14, then coil spring 13 compresses a desired compression C and casing 14 translates a desired distance T causing detent 17 to engage groove 215 inducing an audible indication that a desired loading pressure has been reached.

While the present invention is described herein with reference to illustrated embodiments, it should be understood that the invention is not limited hereto. Those having ordinary skill in the art and access to the teachings herein will recognize additional modifications and embodiments within the scope thereof. Accordingly, such modifications and/or embodiments are considered to be included within the scope of the present invention.

What is claimed:

1. An apparatus for loading a barrel of a muzzle loading firearm to provide powder and a projectile at a breech end of the barrel, which comprises:

(a) a handle having a central longitudinal axis and adapted to be gripped by one hand, the handle having an opening between opposed ends along the axis;

(b) a moveable casing having a head and mounted in the opening adjacent one end of the handle and adapted to receive a ramrod of the muzzle loading rifle into the casing;

(c) a retaining means for retaining the casing within the opening, the retaining means mounted on the handle with at least a portion of the retaining means mounted inside the opening; and (d) a coil spring mounted in the opening inside the handle between the portion of the retaining means mounted in the opening and the head of the casing, wherein when the ramrod is used to force the projectile onto powder in the barrel at the breech end, the casing is moved towards the portion of retaining means against the coil spring to pressure the projectile against the powder wherein the casing is a rimless casing with an extraction groove which engages a detent mounted through the handle into the opening when the casing is pushed back against the spring by the ramrod to provide an audible sound indicating that a predetermined pressure of the projectile on the powder in the barrel has been achieved.

2. The apparatus of claim 1, wherein the retaining means comprises a starter for the projectile extending from one end of the handle, the starter is adapted to start a projectile in the barrel of the muzzle loading firearm.

3. An apparatus for loading a barrel of a muzzle loading firearm to provide powder and a projectile at a breech end of the barrel, which comprises:

(a) a handle having a central longitudinal axis and adapted to be gripped by one hand, the handle having opposed, flanged ends, wherein the handle has a cylindrical opening between the flanged ends along the axis;

(b) a moveable casing having a head and mounted in the cylindrical opening adjacent one flanged end of the handle and adapted to receive a ramrod of the muzzle loading rifle into the casing;

(c) a retaining means for retaining the casing within the cylindrical opening, the retaining means mounted on the handle with at least a portion of the retaining means mounted inside the cylindrical opening; and (d) a coil spring mounted in the cylindrical opening inside the handle between the portion of the retaining means mounted in the cylindrical opening and the head of the casing, wherein when the ramrod is used to force the projectile onto powder in the barrel at the breech end, the casing is moved towards the portion of the retaining means against the coil spring to pressure the projectile against the powder wherein the casing is a rimless casing with an extraction groove which engages a detent mounted through the handle into the opening when the casing is pushed back against the spring by the ramrod to provide an audible sound indicating that a predetermined pressure of the projectile on the powder in the barrel has been achieved.

4. The apparatus of claim 3, wherein the retaining means comprises a starter for the projectile extending from one end of the handle, the starter is adapted to start a projectile in the barrel of the muzzle loading firearm.

5. The apparatus of claim 4, wherein the starter defines a pocket that is sized and shaped to receive a portion of the projectile to be seated in the barrel of the muzzle loading firearm.

6. The apparatus of claim 4, wherein the cylindrical opening defines a keyed recess parallel to the axis partially extending along an internal surface of the opening and sized and shaped to receive a keyed boss extending along the starter for alignment and mounting of the starter in the handle, and wherein the keyed recess defines a stop to abut against the keyed boss of the starter to prevent further insertion of the starter into the cylindrical opening.

7. The apparatus of claim 6, wherein the starter is securely held within the cylindrical opening by a securing means.

8. The apparatus of claim 3, wherein the detent comprises a spring loaded ball bearing mounted in a threaded member and mounted in a threaded opening extending perpendicular to the longitudinal axis of the handle.

9. The apparatus of claim 3, wherein the coil spring defines a predetermined tension adapted to receive pressure from the ramrod pressing against the casing until a desired pound of pressure is achieved in loading the projectile in the barrel of the muzzle loading firearm.

10. An apparatus for loading a barrel of a muzzle loading firearm to provide powder and a projectile at a breech end of the barrel, which comprises:

(a) a handle having a central longitudinal axis and adapted to be gripped by one hand, the handle having opposed, flanged ends, wherein the handle has a cylindrical opening between the flanged ends along the axis;

(b) a moveable casing having a head and mounted in the cylindrical opening adjacent one flanged end of the handle and adapted to receive a ramrod of the muzzle loading rifle into the casing;

(c) a starter for the projectile mounted on the handle with an end extending from the other flanged end of the handle with a portion of the starter mounted inside the cylindrical opening, the starter is adapted to start a projectile in the barrel of the muzzle loading firearm; and (d) a coil spring mounted in the cylindrical opening inside the handle between the portion of the starter mounted in the cylindrical opening and the head of the casing, wherein when the ramrod is used to force the projectile onto powder in the barrel at the breech end, the casing is moved towards the portion of the starter against the coil spring to pressure the projectile against the powder wherein the casing is a rimless casing with an extraction groove which engages a detent mounted through the handle into the opening when the casing is pushed back against the spring by the ramrod to provide an audible sound indicating that a predetermined pressure of the projectile on the powder in the barrel has been achieved.

11. The apparatus of claim 10, wherein the detent comprises a spring loaded ball bearing mounted in a threaded member and mounted in a threaded opening extending perpendicular to the longitudinal axis of the handle.

12. A method for loading a barrel of a muzzle loading firearm to provide powder and a projectile at a breech end of the barrel, which comprises the steps of:

(a) providing an apparatus for loading a barrel of a muzzle loading firearm comprised of: (i) a handle having a central longitudinal axis and adapted to be gripped by one hand, the handle having an opening between opposed ends along the axis; (ii) a moveable casing having a head and mounted in the opening adjacent one end of the handle and adapted to receive a ramrod of the muzzle loading rifle into the casing; (iii) a retaining means for retaining the casing within the opening, the retaining means mounted on the handle with at least a portion of the retaining means mounted inside the opening, and (iv) a coil spring mounted in the opening inside the handle between the portion of the retaining means mounted in the opening and the head of the casing, wherein when the ramrod is used to force the projectile onto powder in the barrel at the breech end, the casing is moved towards the portion of retaining means against the coil spring to pressure the projectile against the powder wherein the casing is a rimless casing with an extraction groove which engages a detent mounted through the handle into the opening when the casing is pushed back against the spring by the ramrod to provide an audible sound indicating that a predetermined pressure of the projectile on the powder in the barrel has been achieved;

(b) seating a projectile in the barrel of a muzzle loading firearm; and (c) inserting the projectile into the barrel with one end of a ramrod by placing the opposite end of the ramrod into the cylindrical opening against the casing.

13. A method for loading a barrel of a muzzle loading firearm to provide powder and a projectile at a breech end of the barrel, which comprises the steps of:

(a) providing an apparatus for loading a barrel of a muzzle loading firearm comprised of: (i) a handle having a central longitudinal axis and adapted to be gripped by one hand, the handle having opposed, flanged ends, wherein the handle has a cylindrical opening between the flanged ends along the axis; (ii) a moveable casing having a head and mounted in the cylindrical opening adjacent one flanged end of the handle and adapted to receive a ramrod of the muzzle loading rifle into the casing; (iii) a retaining means for retaining the casing within the cylindrical opening, the retaining means mounted on the handle with at least a portion of the retaining means mounted inside the cylindrical opening, and (iv) a coil spring mounted in the cylindrical opening inside the handle between the portion of the retaining means mounted in the cylindrical opening and the head of the casing, wherein when the ramrod is used to force the projectile onto powder in the barrel at the breech end, the casing is moved towards the portion of the retaining means against the coil spring to pressure the projectile against the powder;

(b) seating a projectile in the barrel of a muzzle loading firearm; and (c) inserting the projectile into the barrel with one end of a ramrod by placing the opposite end of the ramrod into the cylindrical opening against the casing wherein the casing is a rimless casing with an extraction groove which engages a detent mounted through the handle into the opening when the casing is pushed back against the spring by the ramrod to provide an audible sound indicating that a predetermined pressure of the projectile on the powder in the barrel has been achieved.

14. The method of claim 13, wherein the retaining means comprises a starter for the projectile extending from one end of the handle, the starter is adapted to start a projectile in the barrel of the muzzle loading firearm.

15. The apparatus of claim 14, wherein the starter defines a pocket that is sized and shaped to receive a portion of the projectile to be seated in the barrel of the muzzle loading firearm.

16. The apparatus of claim 14, wherein the starter is securely held within the cylindrical opening by a securing means.

17. The apparatus of claim 14, wherein the cylindrical opening defines a keyed recess parallel to the axis partially extending along an internal surface of the handle and sized and shaped to receive a keyed boss extending along the starter for alignment and mounting of the starter in the handle, and wherein the keyed recess defines a stop to abut against the keyed boss of the starter to prevent further insertion of the starter into the cylindrical opening.

18. The method of claim 13, wherein the detent comprises a spring loaded ball bearing mounted in a threaded member and mounted in a threaded opening perpendicular to the longitudinal axis of the handle.

19. The method of claim 13, wherein the coil spring defines a predetermined tension adapted to receive pressure from the ramrod pressing against the casing until a desired pound of pressure is achieved in loading the projectile in the barrel of the muzzle loading firearm.

* * * * *